US006186087B1

(12) United States Patent
Vinas

(10) Patent No.: US 6,186,087 B1
(45) Date of Patent: Feb. 13, 2001

(54) FISHING ROD PROTECTOR ASSEMBLY

(76) Inventor: Lewis G. Vinas, 331 Haymarket, Houston, TX (US) 77015

( * ) Notice: Under 35 U.S.C. 154(b), the term of this patent shall be extended for 0 days.

(21) Appl. No.: 09/484,466

(22) Filed: Jan. 14, 2000

(51) Int. Cl.[7] ..... B63B 8/00
(52) U.S. Cl. ..... 114/343; 211/70.8
(58) Field of Search ..... 114/364, 343, 114/255; 211/70.8; 43/26

(56) References Cited

U.S. PATENT DOCUMENTS

| | | | | |
|---|---|---|---|---|
| D. 388,498 | | 12/1997 | Hamilton . | |
| 4,170,801 | * | 10/1979 | Ward | 114/343 |
| 4,523,704 | * | 6/1985 | Washington | 224/328 |
| 4,765,083 | | 8/1988 | Wilkins . | |
| 4,858,366 | | 8/1989 | Rushton . | |
| 4,974,537 | * | 12/1990 | Martin | 144/255 |
| 5,152,494 | | 10/1992 | Frunzar . | |
| 5,586,515 | | 12/1996 | Nickles . | |
| 5,588,542 | * | 12/1996 | Winkler, Jr. et al. | 211/70.8 |
| 5,815,979 | | 10/1998 | George . | |

* cited by examiner

*Primary Examiner*—Ed Swinehart

(57) ABSTRACT

A fishing rod protector assembly for protecting the fishing rod from being damaged when the fishing rod is secured to a boat deck. The fishing rod protector assembly is designed for use on a boat having a fishing rod holder for holding multiple fishing rods against a deck of the boat. The fishing rod protector assembly includes a main member pivotally coupled to the boat and a latch member designed for coupling to the boat deck to selectively engage the main member. The main member is positioned such that the top of the main member is positioned over the end of a fishing rod engaged to a fishing rod holder on the boat deck.

8 Claims, 2 Drawing Sheets

FISHING ROD PROTECTOR ASSEMBLY

BACKGROUND OF THE INVENTION

1. Field of the Invention

The present invention relates to fishing rod protectors and more particularly pertains to a new fishing rod protector assembly for protecting the fishing rod from being damaged when the fishing rod is secured to a boat deck.

2. Description of the Prior Art

The use of fishing rod protectors is known in the prior art. More specifically, fishing rod protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,815979; U.S. Pat. No. 4,765,083; U.S. Pat. No. 4,858,366; U.S. Pat. No. 5,586,515; U.S. Pat. No. Des. 388,498; and U.S. Pat. No. 5,152,494.

While these devices fulfill their respective, particular objectives and requirements, the aforementioned patents do not disclose a new fishing rod protector assembly. The inventive device is designed for coupling to a boat including a fishing rod holder for holding multiple fishing rods against a deck of the boat. The fishing rod protector assembly includes a main member pivotally coupled to the boat and a latch member designed for coupling to the boat deck to selectively engage the main member. The main member is positioned such that the top of the main member is positioned over the end of a fishing rod engaged to a fishing rod holder on the boat deck.

In these respects, the fishing rod protector assembly according to the present invention substantially departs from the conventional concepts and designs of the prior art, and in so doing provides an apparatus primarily developed for the purpose of protecting the fishing rod from being damaged when the fishing rod is secured to a boat deck.

SUMMARY OF THE INVENTION

In view of the foregoing disadvantages inherent in the known types of fishing rod protectors now present in the prior art, the present invention provides a new fishing rod protector assembly construction wherein the same can be utilized for protecting the fishing rod from being damaged when the fishing rod is secured to a boat deck.

The general purpose of the present invention, which will be described subsequently in greater detail, is to provide a new fishing rod protector assembly apparatus and method which has many of the advantages of the fishing rod protectors mentioned heretofore and many novel features that result in a new fishing rod protector assembly which is not anticipated, rendered obvious, suggested, or even implied by any of the prior art fishing rod protectors, either alone or in any combination thereof.

To attain this, the present invention generally comprises a fishing rod protector assembly designed for use on a boat having a fishing rod holder for holding multiple fishing rods against a deck of the boat. The fishing rod protector assembly includes a main member pivotally coupled to the boat and a latch member designed for coupling to the boat deck to selectively engage the main member. The main member is positioned such that the top of the main member is positioned over the end of a fishing rod engaged to a fishing rod holder on the boat deck.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fishing rod protector assembly apparatus and method which has many of the advantages of the fishing rod protectors mentioned heretofore and many novel features that result in a new fishing rod protector assembly which is not anticipated, rendered obvious, suggested, or even implied by any of the prior art fishing rod protectors, either alone or in any combination thereof.

It is another object of the present invention to provide a new fishing rod protector assembly, which may be easily and efficiently manufactured and marketed.

It is a further object of the present invention to provide a new fishing rod protector assembly, which is of a durable and reliable construction.

An even further object of the present invention is to provide a new fishing rod protector assembly which is susceptible of a low cost of manufacture with regard to both materials and labor, and which accordingly is then susceptible of low prices of sale to the consuming public, thereby making such fishing rod protector assembly economically available to the buying public.

Still yet another object of the present invention is to provide a new fishing rod protector assembly which provides in the apparatuses and methods of the prior art some of the advantages thereof, while simultaneously overcoming some of the disadvantages normally associated therewith.

Still another object of the present invention is to provide a new fishing rod protector assembly for protecting the fishing rod from being damaged when the fishing rod is secured to a boat deck.

Yet another object of the present invention is to provide a new fishing rod protector assembly which includes a main member pivotally coupled to a boat deck and a latch member designed for coupling to the boat deck to selectively engage the main member. The main member is positioned such that the top of the main member is positioned over the end of a fishing rod engaged to a fishing rod holder on the boat deck.

Still yet another object of the present invention is to provide a new fishing rod protector assembly that protects the fishing rod tips from being damaged by a user when fishing.

Even still another object of the present invention is to provide a new fishing rod protector assembly that is cost effective for the user, simple for a user to install while providing easy access to fishing rods when fishing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
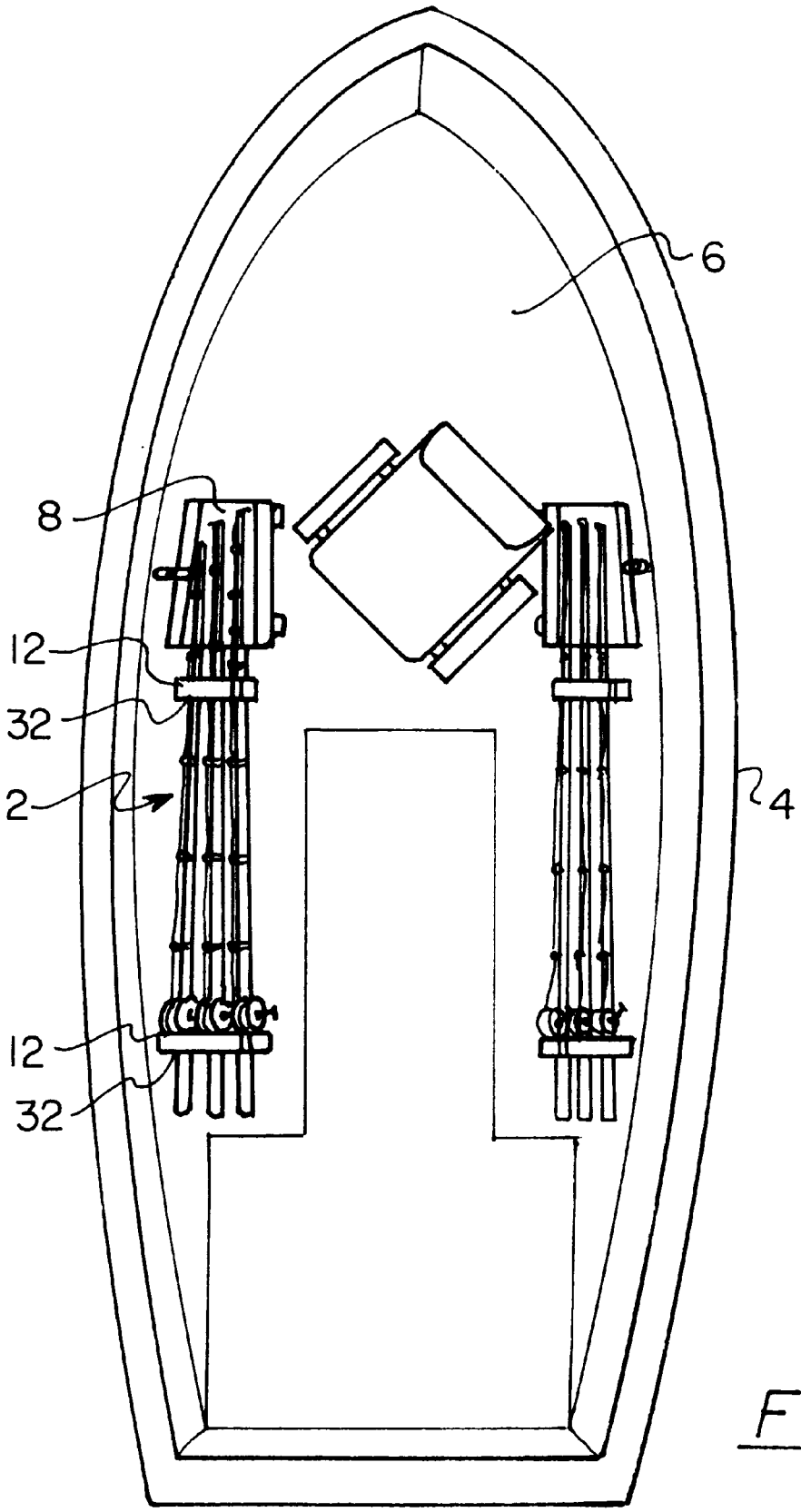
FIG. 1 is a top view of a new fishing rod protector assembly in a boat.
Figure 2:
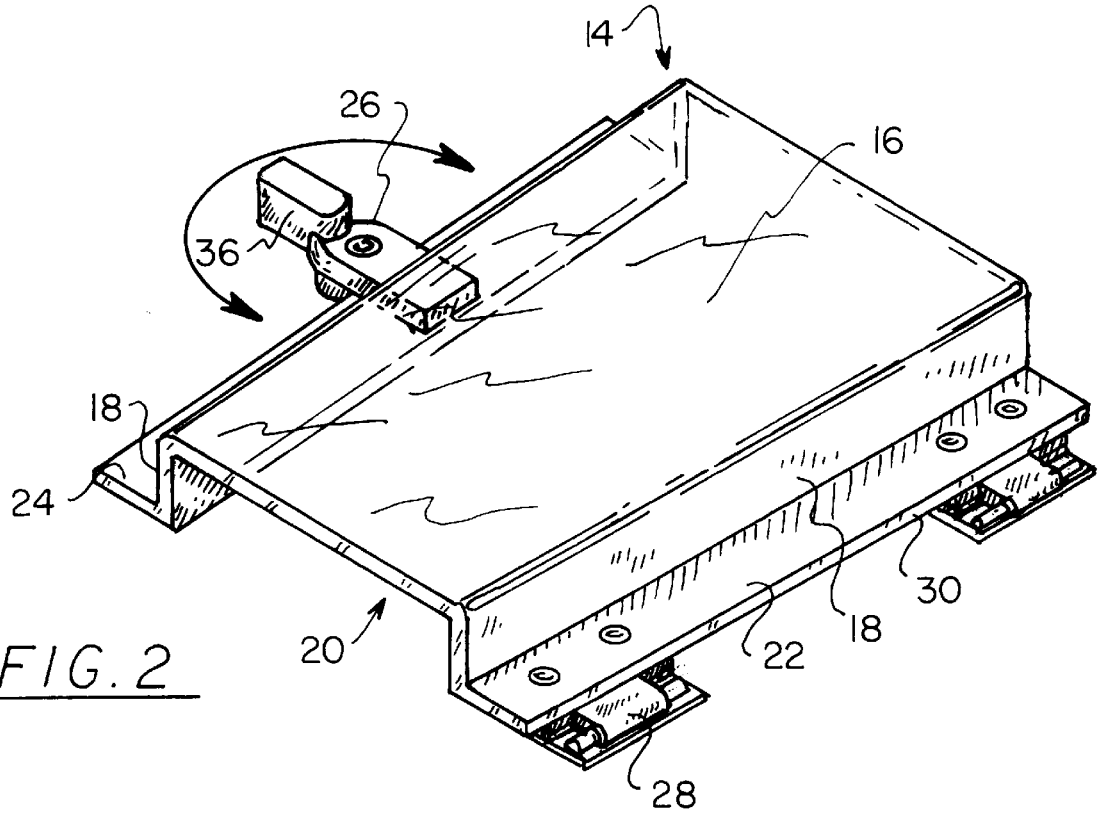
FIG. 2 is a perspective view of the present invention.
Figure 3:
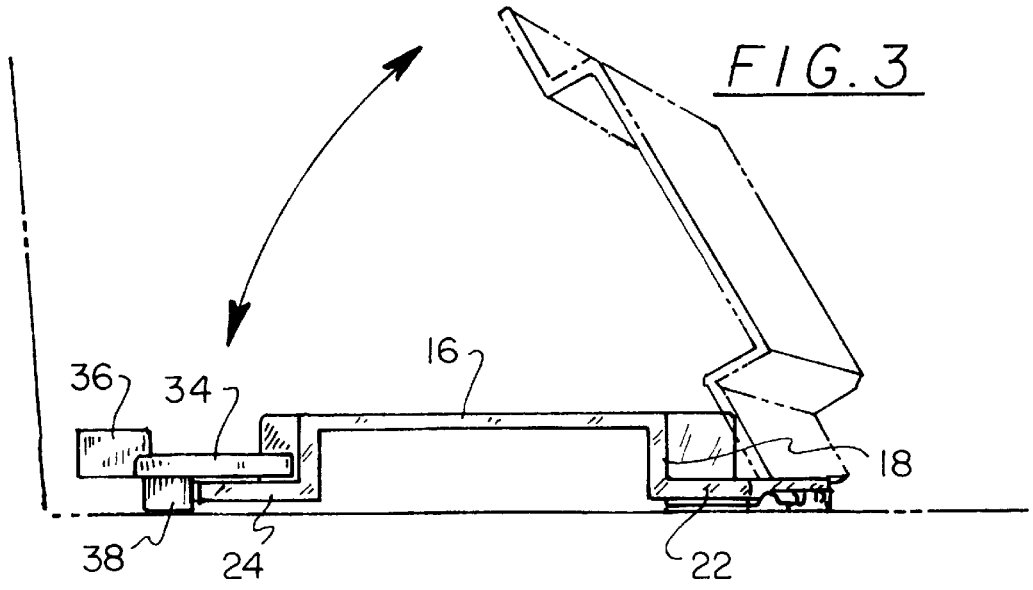
FIG. 3 is an end view of the present invention.

With reference now to the drawings, and in particular to FIGS. 1 through 3 thereof, a new fishing rod protector assembly embodying the principles and concepts of the present invention and generally designated by the reference numeral 10 will be described.

As best illustrated in FIGS. 1 through 3, the fishing rod protector assembly 10 is designed for coupling to a boat 4 including a fishing rod holder 12 for holding multiple fishing rods 2 against a deck 6 of the boat 4. The fishing rod protector assembly 10 includes a main member 14 including a top 16, sides 18 extending from the top 16, and a pair of open ends 20. The main member 14 also includes a connection flange 22 extending outwardly from a first one of the sides 18. The main member 14 also includes a latching flange 24 extending outwardly from a second one of the sides 18. The connection flange 22 is designed for hingably coupling to the boat deck 6 such that the main member 14 is pivotable between an open and a closed position. A latch member 26 is designed for coupling to the boat deck 6 such that the latch member 26 is positioned to selectively engage the latching flange 24 when the main member 14 is in the closed position. The main member 14 is positioned such that the top 16 of the main member 14 is designed for positioning over a distal end of a fishing rod 8 engaged to the fishing rod holder 12 for preventing contact of a foot of a user with the distal end of the fishing rod 8.

In an embodiment, the main member 14 is substantially clear for permitting visual inspection of the distal end of the fishing rod 8 when the main member is in the closed position. A pair of hinges 28 are coupled to the connecting flange 22 proximate a respective end 30 of the main member 14. Each of the hinges 28 is designed for coupling to the boat deck 6. Thus, the main member 14 is hingably attached to the boat deck 6.

In an embodiment, the top of the main member 14 is generally trapezoidal such that a first one of the open ends 20 has a length greater than a second one of the open ends 20. The first open end 20 is positioned nearer the rod engaging member 32 than the second open end. The latch member 26 includes a flange holding portion 34, a gripping portion 36, and a medial portion 38 between the flange holding portion 34 and the gripping portion 36. The medial portion 38 is designed for coupling to the boat deck 6 such that the latch member 26 is rotatable around the medial portion 38 for selectively engaging and disengaging the flange holding portion 34 from the latching flange 24. The gripping portion 36 extends upwardly from an upper surface of the medial portion 38 for facilitating grasping of the gripping portion 36 by a user.

In an embodiment, the fishing rod protector is generally trapezoidal such that a first one of the open ends has a width that is 7 inches and a second one of the open ends has a width of 5 inches. The height of the fishing rod protector is 1 inch; and the overall length of the protector is 20 inches.

In use, a user can safely cover the ends of multiple fishing rods with the rod protector by opening the cover and placing the tip of the fishing rod in position, then closing and latching the cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fishing rod protector assembly for coupling to a boat having a fishing rod holder for holding a plurality of fishing rods against a deck of the boat, the fishing rod protector assembly comprising:

a main member having a top, sides extending from the top, and a pair of open ends;

said main member having a connection flange extending outwardly from a first one of said sides;

said main member having a latching flange extending outwardly from a second one of said sides;

said connection flange being adapted for hingably coupling to the boat deck such that said main member is pivotable between an open and a closed position, said open position being defined by said latching flange being positioned in spaced relationship to the boat deck, said closed position being defined by said latching flange contacting the boat deck;

a latch member adapted for coupling to the boat deck such that the latch member is positioned to selectively engage said latching flange when said main member is in said closed position; and said main member being positioned such that said top of said main member is adapted for positioning over a distal end of a fishing rod engaged to the fishing rod holder for preventing contact of a foot of a user with the distal end of the fishing rod.

2. The fishing rod protector assembly of claim 1, further comprising:

said main member being substantially clear for permitting visual inspection of the distal end of the fishing rod when said main member is in said closed position.

3. The fishing rod protector assembly of claim 1, further comprising:

a pair of hinges, each of said hinges being coupled to said connecting flange proximate a respective end of said main member, each of said hinges being adapted for coupling to the boat deck whereby said main member is hingably couplable to the boat deck.

4. The fishing rod protector assembly of claim 1, further comprising:

said top of said main member being generally trapezoidal such that a first one of said open ends has a length greater than a second one of said open ends, said first open end being positioned nearer said rod engaging member than said second open end.

5. The fishing rod protector assembly of claim 1, further comprising:

said latch member having a flange holding portion, a gripping portion, and a medial portion between said flange holding portion and said gripping portion;

said medial portion being adapted for coupling to the boat deck such that the latch member is rotatable around said medial portion for selectively engaging and disengaging said flange holding portion from said latching flange.

6. The fishing rod protector assembly of claim 5, further comprising:

said gripping portion extending upwardly from an upper surface of said medial portion for facilitating grasping of said gripping portion by a user.

7. A fishing rod protector assembly for coupling to a boat having a fishing rod holder for holding a plurality of fishing rods against a deck of the boat, the fishing rod protector assembly comprising:

a main member having a top, sides extending from the top, and a pair of open ends;

said main member having a connection flange extending outwardly from a first one of said sides;

said main member having a latching flange extending outwardly from a second one of said sides;

said connection flange being adapted for hingably coupling to the boat deck such that said main member is pivotable between an open and a closed position, said open position being defined by said latching flange being positioned in spaced relationship to the boat deck, said closed position being defined by said latching flange contacting the boat deck;

a latch member adapted for coupling to the boat deck such that the latch member is positioned to selectively engage said latching flange when said main member is in said closed position;

said main member being positioned such that said top of said main member is adapted for positioning over a distal end of a fishing rod engaged to the fishing rod holder for preventing contact of a foot of a user with the distal end of the fishing rod;

said main member being substantially clear for permitting visual inspection of the distal end of the fishing rod when said main member is in said closed position;

a pair of hinges, each of said hinges being coupled to said connecting flange proximate a respective end of said main member, each of said hinges being adapted for coupling to the boat deck whereby said main member is hingably couplable to the boat deck;

said top of said main member being generally trapezoidal such that a first one of said open ends has a length greater than a second one of said open ends, said first open end being positioned nearer said rod engaging member than said second open end;

said latch member having a flange holding portion, a gripping portion, and a medial portion between said flange holding portion and said gripping portion;

said medial portion being adapted for coupling to the boat deck such that the latch member is rotatable around said medial portion for selectively engaging and disengaging said flange holding portion from said latching flange; and said gripping portion extending upwardly from an upper surface of said medial portion for facilitating grasping of said gripping portion by a user.

8. A fishing rod protector assembly comprising, in combination:

a fishing boat having a raised boat deck, a fishing chair coupled to said raised boat deck, and a pair of rod holders, each rod holder being for holding a plurality of fishing rods such that a distal end of each fishing rod held by a respective one of said fishing rod holders extends along said raised boat deck proximate said fishing chair; and a pair of fishing rod protectors, each fishing rod protector being aligned with an associated one of said fishing rod holders, each fishing rod protector comprising:

a main member having a top, sides extending from the top, and a pair of open ends;

said main member having a connection flange extending outwardly from a first one of said sides;

said main member having a latching flange extending outwardly from a second one of said sides;

said connection flange being for hingably coupling to said raised boat deck such that said main member is pivotable between an open and a closed position, said open position being defined by said latching flange being positioned in spaced relationship to said raised boat deck, said closed position being defined by said latching flange contacting said raised boat deck;

a latch member for coupling to said raised boat deck such that said latch member is positioned to selectively engage said latching flange when said main member is in said closed position;

said main member being positioned such that said top of said main member is positionable over a portion of a fishing rod engaged to an associated one of said fishing rod holders for preventing contact of a foot of a user with the portion of the fishing rod positioned beneath said main member;

said main member being substantially clear for permitting visual inspection of the portion of the fishing rod positioned beneath said main member when said main member is in said closed position;

a pair of hinges, each of said hinges being coupled to said connecting flange proximate a respective end of said main member, each of said hinges being coupled to said raised boat deck;

said top of said main member being generally trapezoidal such that a first one of said open ends has a length greater than a second one of said open ends, said first open end being positioned nearer said rod engaging member than said second open end;

said latch member having a flange holding portion, a gripping portion, and a medial portion between said flange holding portion and said gripping portion;

said medial portion being coupled to the boat deck such that the latch member is rotatable around said medial portion for selectively engaging and disengaging said flange holding portion from said latching flange; and said gripping portion extending upwardly from an upper surface of said medial portion for facilitating grasping of said gripping portion by a user.

* * * * *